US007069949B2

(12) United States Patent
Koyama

(10) Patent No.: US 7,069,949 B2
(45) Date of Patent: Jul. 4, 2006

(54) FOUR-WAY SWITCHING VALVE

(75) Inventor: Katsumi Koyama, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 231 days.

(21) Appl. No.: 10/842,442

(22) Filed: May 11, 2004

(65) Prior Publication Data

US 2004/0226618 A1 Nov. 18, 2004

(30) Foreign Application Priority Data

May 15, 2003 (JP) ..... 2003-137684

(51) Int. Cl.
*F16K 11/22* (2006.01)

(52) U.S. Cl. ..... 137/596

(58) Field of Classification Search ..... 137/596, 137/625.43; 62/325

See application file for complete search history.

(56) References Cited

U.S. PATENT DOCUMENTS 4,055,056 A * 10/1977 Perkins ..... 62/324.6
6,823,897 B1 * 11/2004 Hirota et al. ..... 137/885
6,860,294 B1 * 3/2005 Hirota et al. ..... 137/625.43

FOREIGN PATENT DOCUMENTS

JP 7-151251 6/1995
JP 2004-19718 1/2004

* cited by examiner

*Primary Examiner*—John Fox
(74) *Attorney, Agent, or Firm*—Westerman, Hattori, Daniels & Adrian, LLP.

(57) ABSTRACT

The object of the present invention is to provide a simple-construction four-way switching valve which is simple in construction and excellent in sealability, performs switching of the operation mode without producing unusual noise, and is reduced in the number of manufacturing steps through elimination of externally-mounted parts for pressure passages. Main valves having a poppet valve structure constitute a three way switching valve which is operated by a pilot valve, for switching the high-pressure refrigerant introduced into the port T1 to the port T2 or to the port T3, and main valves which have a poppet valve structure and are switched by the differential pressure between the ports T2 and T3 constitute a low-pressure three-way switching valve. This makes it possible to improve the sealability, prevent unusual noise from being generated during switching of the operation mode, and simplify the construction. Further, the pressure passage for releasing the back pressures of the pistons that actuate the main valves is formed through the body, which dispenses with externally-mounted parts, such as tubes, so that the number of parts is reduced to make it possible to reduce the size.

5 Claims, 9 Drawing Sheets

A-A

FOUR-WAY SWITCHING VALVE

CROSS-REFERENCES TO RELATED APPLICATIONS, IF ANY

This application claims priority of Japanese Application No.2003-137684 filed on May 15, 2003 and entitled "FOUR-WAY SWITCHING VALVE".

BACKGROUND OF THE INVENTION (1) Field of the Invention

The present invention relates to a four-way switching valve, and more particularly to a four-way switching valve that carries out switching of refrigerant pipes e.g. in a heat pump-type heating and cooling system for an automotive vehicle when the operation mode is switched between heating and cooling operation modes.

(2) Description of the Related Art

In a heating and cooling system for an automotive vehicle, a refrigerating cycle is employed during cooling operation, and engine coolant is used as a heat source during heating operation. Recently, however, due to the improvement in combustion efficiency of the engine, the temperature of the coolant does not rise high enough to obtain sufficient heating temperature in winter. For this reason, there is an increasing demand for a system which can perform both cooling and heating. In a heating and cooling system of this kind, it is necessary to reverse the direction of flow of refrigerant flowing through an indoor heat exchanger and an outdoor heat exchanger, as the system is switched between cooling and heating operations. It is a four-way switching valve that performs switching the direction of flow of the refrigerant.

A four-way switching valve of this type is known which switches a refrigerant passage by causing a cup-shaped valve element to slide (see e.g. Japanese Unexamined patent Publication (Kokai) No. H07-151251 (Paragraph numbers [0035] to [0036], FIG. 3)). This four-way switching valve includes a port for introducing discharge pressure from a compressor, three ports formed side by side such that they open in the same plane, and the cup-shaped valve element for causing two of the three ports to communicate with each other and the remaining one to communicate with the port for introducing discharge pressure. One of the three ports disposed in the center is connected to the suction side of the compressor, and the other two thereof are connected to an indoor heat exchanger and an outdoor heat exchanger, respectively. Pistons are disposed on opposite sides of the valve element in the sliding direction, for actuating the valve element to cause the same to slide on the same plane where the three ports open, and selection control is provided such that a pilot valve introduces high pressure via a tube from the port for introducing high pressure selectively into operating chambers of the pistons, and one of the operating chambers into which the high pressure is not introduced is connected to the port connected to the suction side of the compressor.

With the arrangement of the four-way switching valve, when the pilot valve is in a certain switching position, the discharge pressure is introduced into the operating chamber of one piston via the tube, and the operating chamber of the other piston is connected to the suction side of the compressor via a tube, whereby the one piston actuates the valve element to cause two of the ports formed side by side, which are remote from the one piston, to communicate with each other, and at the same time cut off these two ports from the discharge pressure, and the remaining one of the ports to communicate with the port for introducing the discharge pressure. As a consequence, the cooling and heating system is formed with a refrigerant path along which the refrigerant delivered from the compressor flows to the compressor via the port for introducing the discharge pressure, one of the ports which is not covered with the valve element, a first heat exchanger, an expansion device, a second heat exchanger, and two of the ports which are connected by the valve element, causing the first heat exchanger to perform condensing of the refrigerant and the second heat exchanger to perform evaporation of the refrigerant, whereby the system performs cooling operation by the second heat exchanger.

Inversely, when the pilot valve is in the other switching position, the operating chamber of the one piston is connected to the suction side of the compressor via the tube therefor, and the discharge pressure is introduced into the operating chamber of the other piston, whereby the other piston actuates the valve element to cause two of the ports formed side by side, which are remote from the other piston, to communicate with each other and at the same time be cut off from the discharge pressure, and one of the ports closest to the other piston to communicate with the port for introducing the discharge pressure. As a consequence, the cooling and heating system is formed with a refrigerant path along which the refrigerant delivered from the compressor flows to the compressor via the port for introducing the discharge pressure, one of the ports which is not covered with the valve element, the second heat exchanger, the expansion device, the first heat exchanger, and two of the ports which are connected by the valve element, causing the second heat exchanger to perform condensing of the refrigerant and the first heat exchanger to perform evaporation of the refrigerant, whereby the system performs heating operation by the second heat exchanger.

However, the conventional four-way switching valve performs the switching of ports by sliding of the valve element, and therefore, a resilient sealing material cannot be used for sliding parts, which degrades the sealability of the four-way switching valve.

Further, the valve element has a structure in which the high discharge pressure is applied to the outside thereof and the low suction pressure is applied to the inside thereof, so that when the switching of ports is carried out when the difference between the high discharge pressure and the low suction pressure is large, the valve element is slid while being pressed against the siding surface by the discharge pressure so that the switching of ports cannot be performed smoothly, sometimes causing unusual noise, such as a snagging sound, to be generated when the valve element passes the openings of the ports.

Further, it is necessary to implement the pressure passages by tubes, for enabling the pilot valve to make high or low the pressure in the operating chamber of each piston that actuates the valve element, which increases the number of component parts and the number of manufacturing steps, and complicates the construction of the valve.

SUMMARY OF THE INVENTION

The present invention has been made in view of the points described above, and an object thereof is to provide a four-way switching valve which is simple in construction and excellent in sealability, performs switching between the heating and cooling operation modes without producing unusual noise, and is reduced in the number of component parts, such as tubes for pressure passages, and in the number of manufacturing steps.

To solve the above problem, the present invention provides a four-way switching valve that performs switching such that a first port communicates with a second port or with a third port, and at the same time performs switching such that a fourth port communicates with the third port or with the second port, the four-way switching valve comprising a high-pressure three-way switching valve that performs switching such that high-pressure refrigerant supplied to the first port is caused to flow to the second port or to the third port, and a low-pressure three-way switching valve that performs switching such that low-pressure refrigerant supplied to the second port or the third port is caused to flow to the fourth port, by a differential pressure generated between pressure in the second port and pressure in the third port according to switching operation of the high-pressure three-way switching valve.

The above and other objects, features and advantages of the present invention will become apparent from the following description when taken in conjunction with the accompanying drawings which illustrate preferred embodiments of the present invention by way of example.

BRIEF DESCRIPTION OF THE DRAWINGS

FIG. 7 is a cross-sectional view of an operating state of the four-way switching valve according to the first embodiment in which the solenoid is on.

DESCRIPTION OF THE PREFERRED EMBODIMENTS

Hereinafter, an embodiment of the present invention which is applied to a heating and cooling system for an automotive vehicle will now be described in detail with reference to drawings, by way of example.

Figure 1:
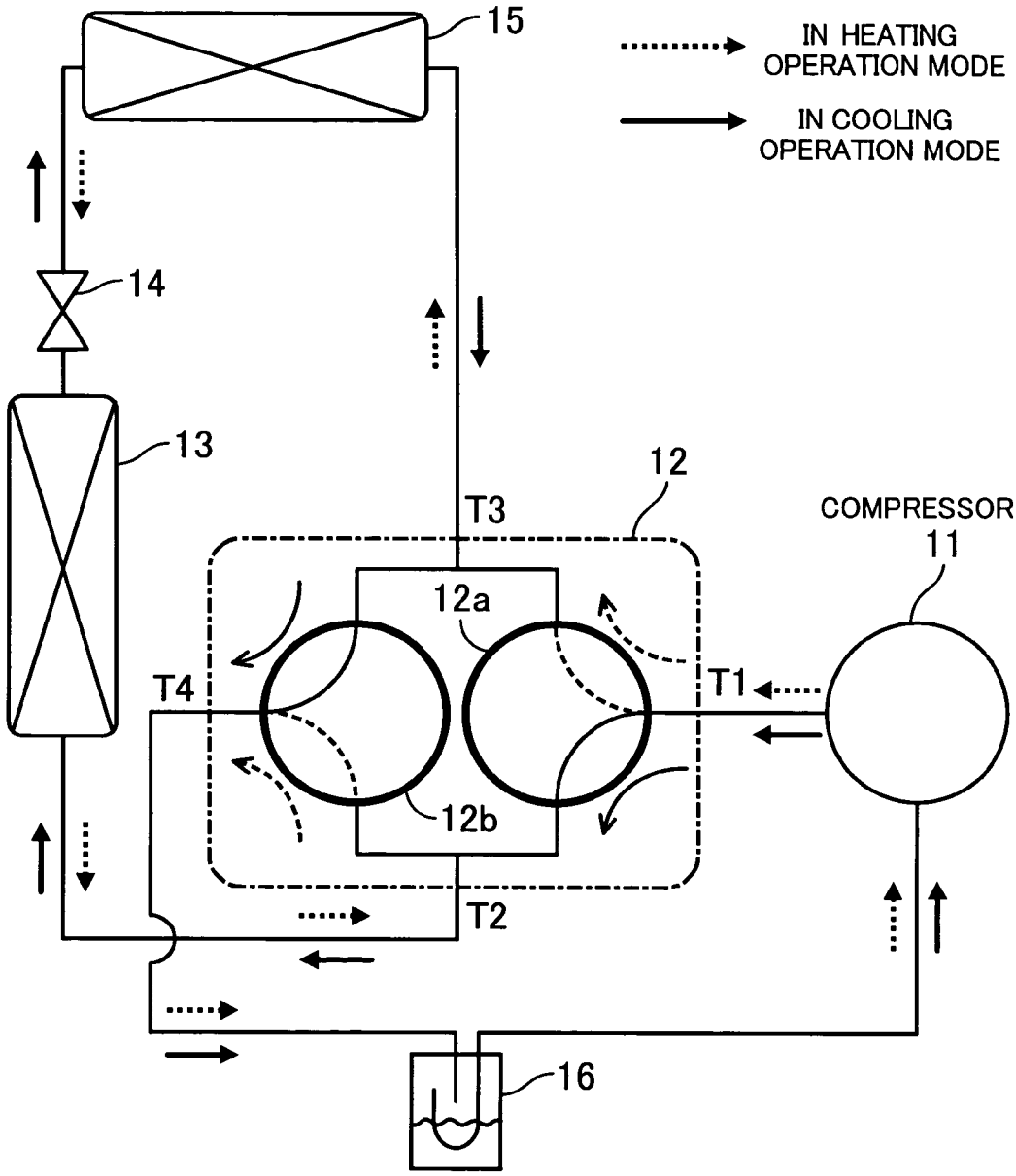
FIG. 1 is a diagram showing the arrangement of a heating and cooling system using a four-way switching valve.

FIG. 1 is a diagram showing the arrangement of a heating and cooling system using the four-way switching valve.

The heating and cooling system is comprised of a compressor 11 driven by an engine for automotive vehicles, the four-way switching valve 12 for performing switching between heating and cooling operation modes, an outdoor heat exchanger 13 for exchanging heat with the outside air, an expansion device 14 formed by an orifice tube, an indoor heat exchanger 15 for exchanging heat with the room air, and an accumulator 16 for separating the refrigerant into gas and liquid.

The four-way switching valve 12 is comprised of two three-way switching valves 12*a* and 12*b* equivalently formed and each having three ports. The combination of these ports provides the four-way switching valve 12 with four ports T1 to T4. The four-way switching valve 12 has the port T1 thereof connected to a discharge pipe of the compressor 11, the port T2 thereof connected to the outdoor heat exchanger 13, the port T3 thereof connected to the indoor heat exchanger 15, and the port T4 thereof connected to a suction pipe of the compressor 11 via the accumulator 16.

In the cooling operation mode, the four-way switching valve 12 is in a state having performed switching such that the ports T1 and T2 communicate with each other and the ports T3 and T4 communicate with each other, as indicated by solid lines in FIG. 1. Therefore, high-pressure, high-temperature refrigerant compressed by the compressor 11 enters the port T1 of the four-way switching valve 12, and is sent via the port T2 to the outdoor heat exchanger 13, wherein the refrigerant is subjected to heat exchange to be condensed, followed by being adiabatically expanded by the expansion device 14 to form low-pressure, low-temperature refrigerant. In the indoor heat exchanger 15, the low-pressure, low-temperature refrigerant exchanges heat with the warm air in the compartment to cool the warm air. The refrigerant evaporated by the heat exchange flows through the ports T3 and T4 to enter the accumulator 16, wherein it is separated into saturated liquid and saturated gas, and the separated saturated gas returns to the compressor 11.

On the other hand, in the heating operation mode, the four-way switching valve 12 is in a state having performed switching such that the ports T1 and T3 communicate with each other and the ports T2 and T4 communicate with each other, as indicated by broken lines in FIG. 1. Therefore, the high-pressure, high-temperature refrigerant compressed by the compressor 11 flows through the ports T1 and T3 of the four-way switching valve 12 into the indoor heat exchanger 15, wherein the refrigerant is subjected to heat exchange to heat the cold air in the compartment. The refrigerant condensed by the heat exchanges is adiabatically expanded by the expansion device 14 to form low-pressure, low-temperature refrigerant, which is subjected to heat exchange in the outdoor heat exchanger 13 to be evaporated, and then flows through the ports T2 and T4 of the four-way switching valve 12 into the accumulator 16, wherein it is separated into saturated liquid and saturated gas, and the separated saturated gas returns to the compressor 11.

Thus, the four-way switching valve 12 performs switching of refrigerant passages to thereby reversibly change the direction of flow of the refrigerant through the outdoor heat exchanger 13, the expansion device 14, and the indoor heat exchanger 15, such that the indoor heat exchanger 15 plays the role of an evaporator during the cooling operation mode and the role of a condenser during the heating operation mode.

Figure 2:
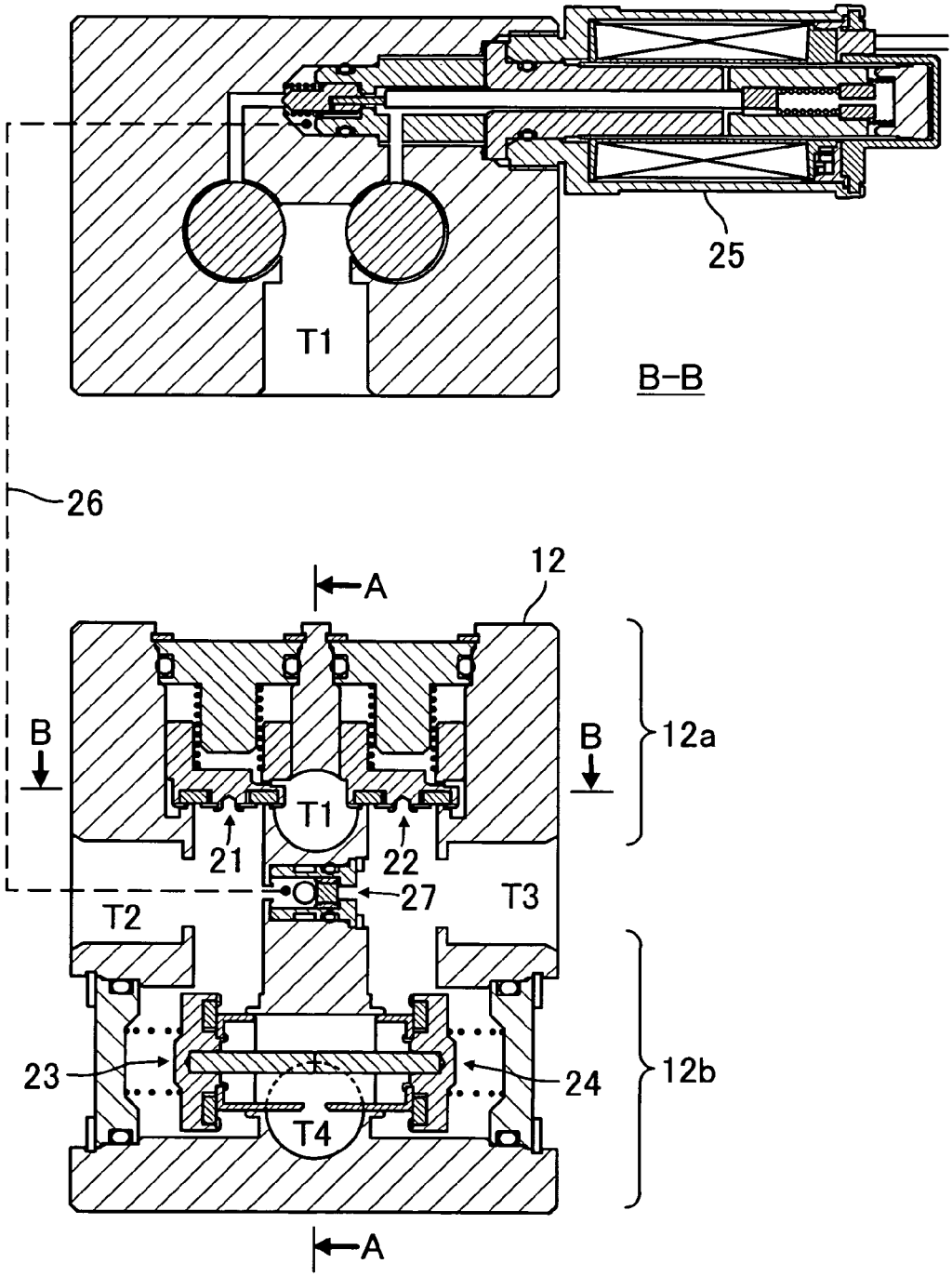
FIG. 2 is a cross-sectional view of the internal construction of a four-way switching valve according to a first embodiment of the present invention in a state where a solenoid is off and refrigerant is not flowing.
Figure 3:
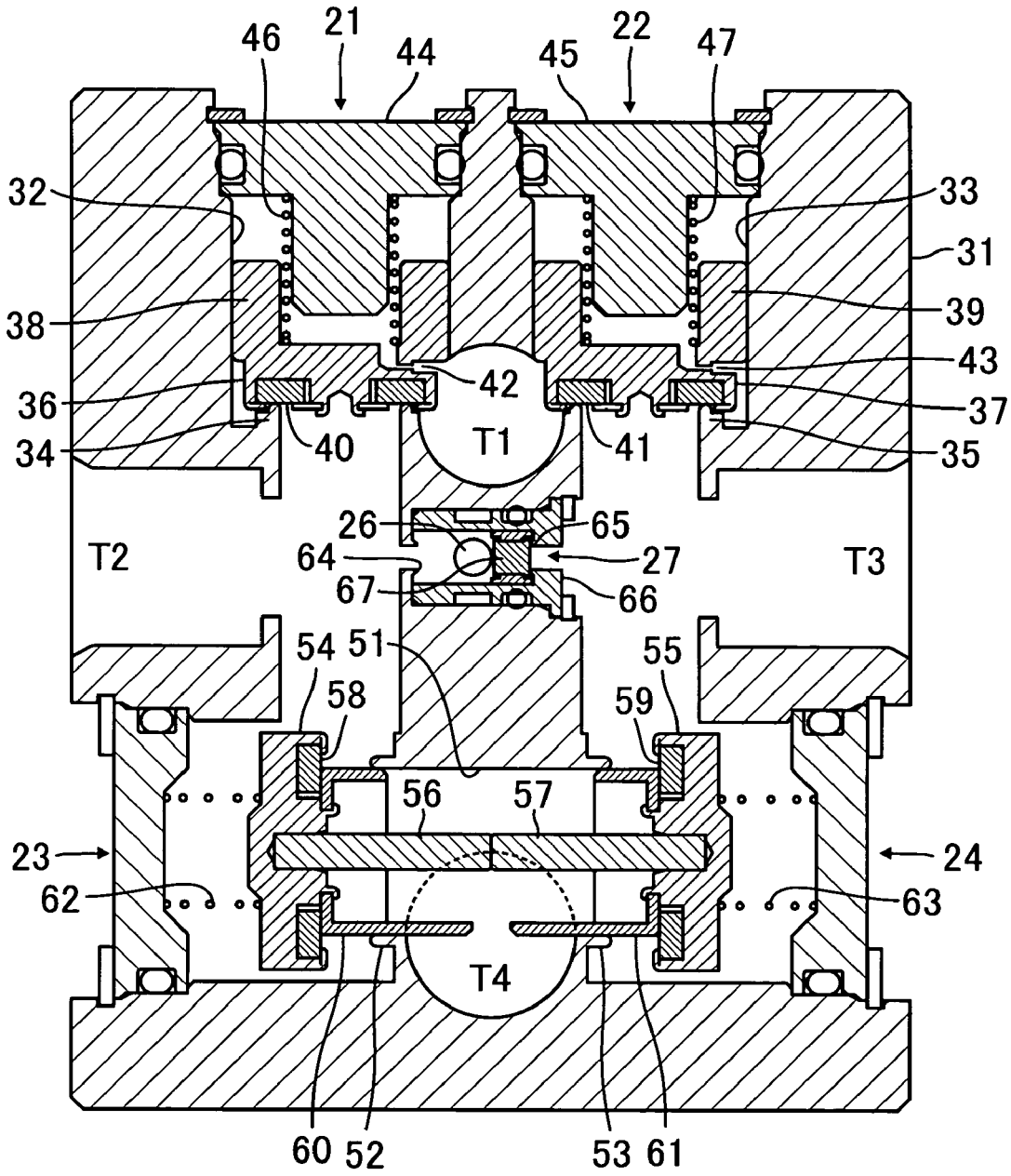
FIG. 3 is a cross-sectional view of an example of the construction of the four-way switching valve according to the first embodiment.
Figure 4:
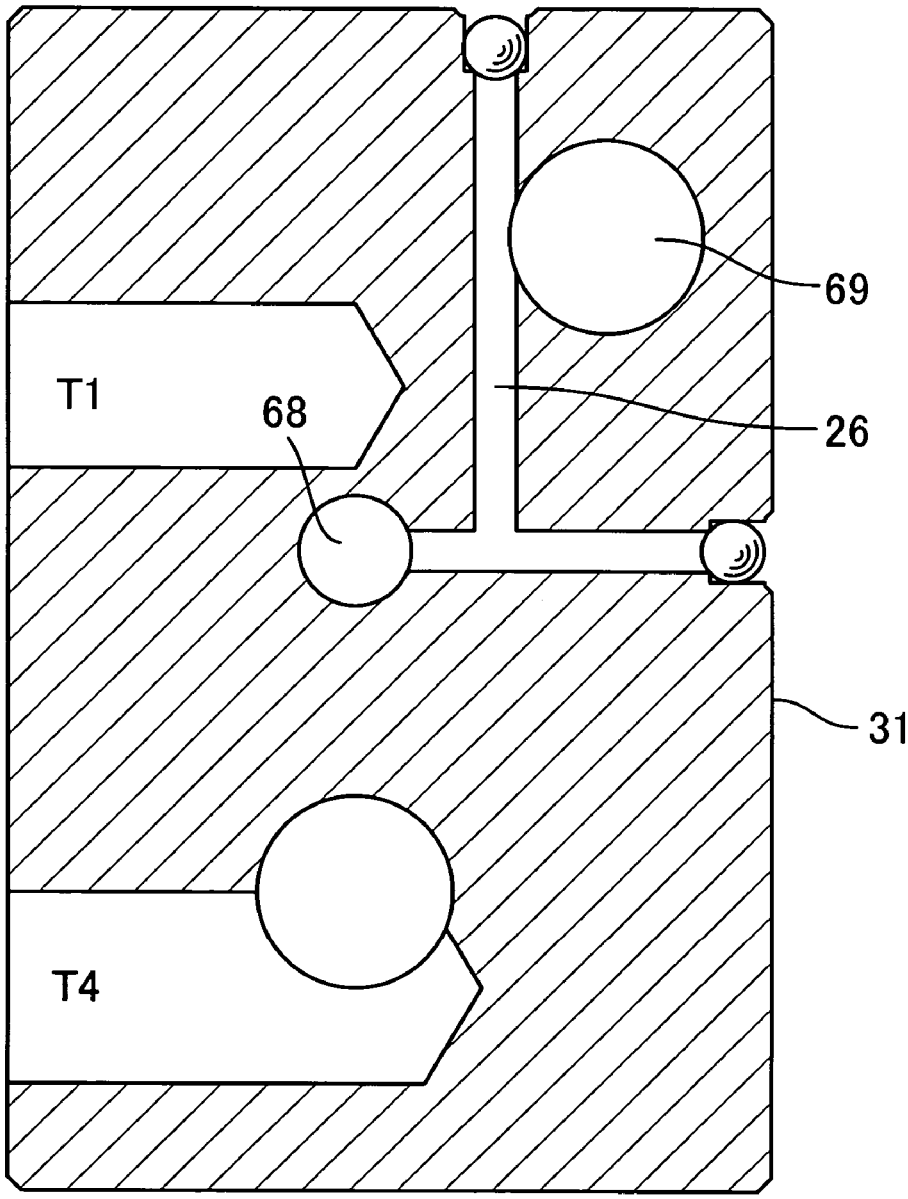
FIG. 4 is a cross-sectional view taken on line A—A of FIG. 2.
Figure 5:
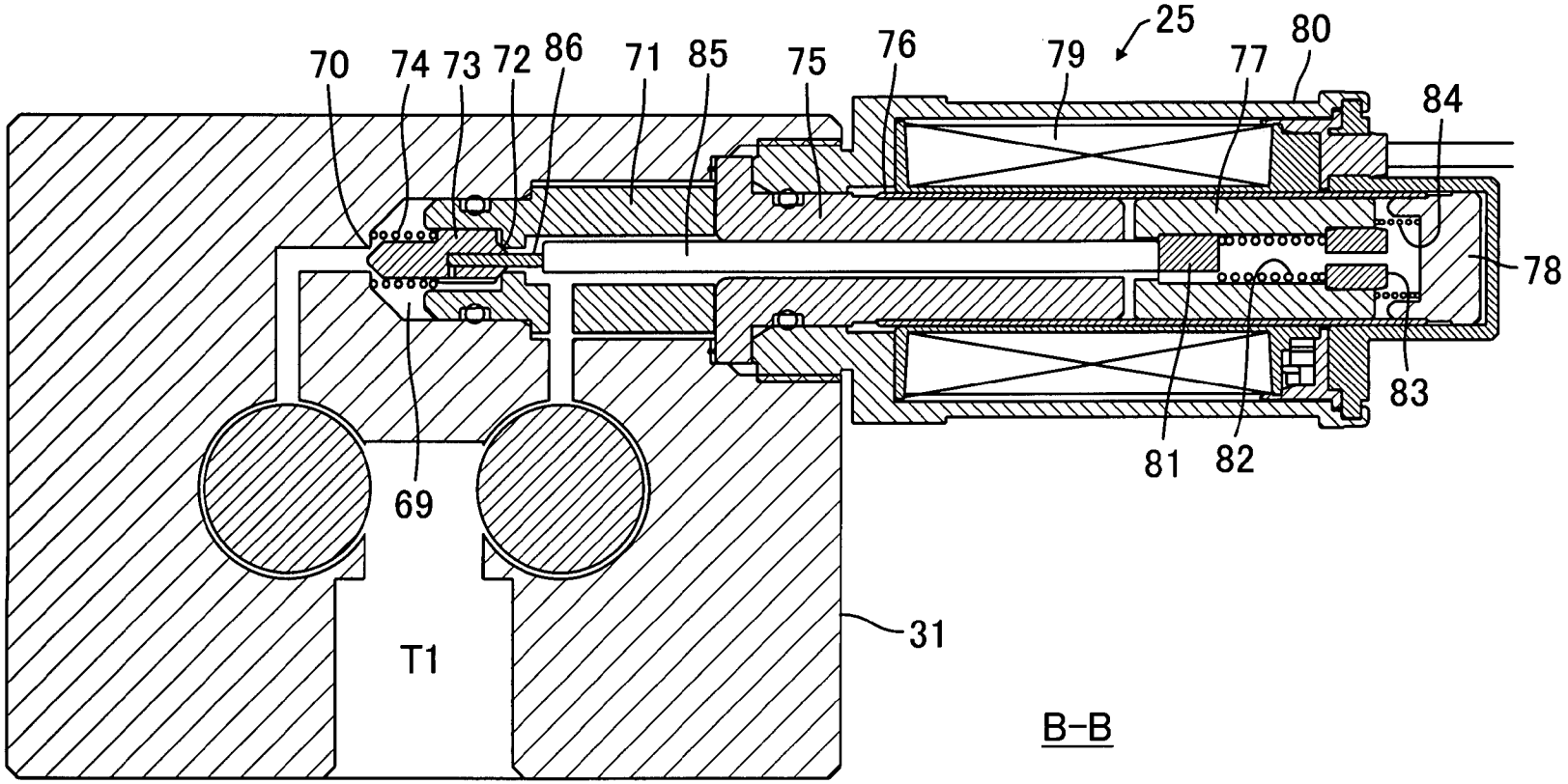
FIG. 5 is a cross-sectional view taken on line B-B of FIG. 2.

FIG. 2 is a cross-sectional view of the internal construction of the four-way switching valve according to the first embodiment of the present invention in a state where the solenoid is off and the refrigerant is not flowing; FIG. 3 is a cross-sectional view of an example of the construction of the four-way switching valve according to the first embodiment; FIG. 4 is a cross-sectional view taken on line A—A of FIG. 2; and FIG. 5 is a cross-sectional view taken on line B—B of FIG. 2.

As shown in FIG. 2, the four-way switching valve 12 according to the first embodiment is comprised of a high-pressure three-way switching valve 12*a* in which two main valves 21 and 22 having a poppet structure are disposed side by side, for performing switching such that the port T1 communicates with the port T2 or with the port T3, a low-pressure three-way switching valve 12*b* in which two main valves 23 and 24 having a poppet structure are disposed on the same axis, for performing switching such that the port T2 or the port T3 communicates with the port T4, and a pilot valve 25 for controlling the back pressures acting on the high-pressure main valves 21 and 22. The pilot valve 25 is constructed as a three-way switching valve, for causing one of back pressure chambers of the main valves 21 and 22 to communicate with a check valve 27 via a pressure passage 26.

As shown in FIG. 3, the four-way switching valve 12 has two cylinders 32 and 33 formed in parallel with each other in an upper part thereof, as viewed in the figure, for receiving the two main valves 21 and 22 therein, and the port T1 for introducing the high-pressure refrigerant is formed such that the port T1 communicates with both of the cylinders 32 and 33. The port T2 and the port T3 are formed below these cylinders 32 and 33, respectively.

The cylinders 32 and 33 extending between the port T1 and the ports T2 and T3 have main valve seats 34 and 35 integrally formed with a body 31. Main valve elements 36 and 37 are disposed in a manner opposed to the main valve seats 34 and 35 such that they can move to the main valve seats 34 and 35 from the port T1 side and away therefrom, and these main valve elements 36 and 37 are integrally formed with the pistons 38 and 39 slidably disposed within the cylinders 32 and 33. The pistons 38 and 39 have larger pressure-receiving areas than those of the main valve elements 36 and 37.

Seal rings 40 and 41 made of a resilient material are fixed to portions of the main valve elements 36 and 37 via which they are seated on the main valves seats 34 and 35, by crimping, via respective washers. The pistons 38 and 39 are formed with orifices 42 and 43 for causing the back pressure chambers thereof to communicate with the port T1, whereby the high-pressure refrigerant in the port T1 is allowed to leak into the back pressure chambers of the pistons 38 and 39. The open ends of the cylinders 32 and 33 are closed by respective plugs 44 and 45, and springs 46 and 47 are disposed between the plugs 44 and 45 and the pistons 38 and 39, respectively, for urging the pistons 38 and 39 in the direction of causing the main valve elements 36 and 37 to be seated on the main valve seats 34 and 35.

The body 31 has a cylinder 51 formed horizontally through a lower part thereof, as viewed in FIG. 3, for communication of the ports T2 and T3 with the port T4, and main valve seats 52 and 53 integrally formed therewith at respective rims of opposite open ends of the cylinder 51. Main valve elements 54 and 55 are disposed in a manner opposed to the main valve seats 52 and 53 such that they can move to the main valve seats 52 and 53 from the outside of the cylinder 51 and away therefrom. The main valve elements 54 and 55 have shafts 56 and 57 extending from respective central portions of sides thereof opposed to each other, and seal rings 58 and 59 made of a resilient material are fixed to portions of the main valve elements 54 and 55 via which they are seated on the main valve seats 52 and 53, by crimping, via respective washers. The main valve elements 54 and 55 have respective hollow-cylindrical skirts 60 and 61 fixed thereto for preventing regions from being formed via which the port T4 simultaneously communicates with the ports T2 and T3 when the main valves 23 and 24 perform switching operations. The skirts 60 and 61 are inserted into the cylinder 51 from the opposite open ends of the cylinder 51, and each have a part of the periphery thereof cut away such that the opposite open ends of the cylinder 51 are substantially closed when the main valve elements 54 and 55 are in a neutral position shown in FIG. 3, and made open when the main valve elements 54 and 55 are moved outward from the neutral position. Further, since the skirts 60 and 61 are inserted into the cylinder 51, they also function as guides of the main valve elements 54 and 55 which are moved to and away from the main valve seats 52 and 53. The main valve elements 54 and 55 are urged by springs 62 and 63 disposed outward thereof for abutment with each other via the shafts 56 and 57.

The port T2 and the port T3 are separated by a partition wall formed with a check valve 27. The check valve 27 is comprised of a valve seat 64 which is integrally formed with the body 31 and has a valve hole thereof opening into the port T2, a plug 66 in which a cylinder and a valve seat 65 are integrally formed and a valve hole opens into the port T3, and a valve element 67 disposed within the plug 66 for reciprocating motion between the valve seats 64 and 65. The space accommodating the valve element 67 communicates with the pilot valve 25 via the pressure passage 26.

As shown in FIG. 4, the pressure passage 26 is formed through the body 31 for communication between a hole 68 in which the check valve 27 is inserted and a hole 69 in which the pilot valve 25 is inserted, and open ends of unused portions of holes formed in the body 31 for forming the pressure passage 26 are closed by metal seals implemented by press-fitted balls.

As shown in FIG. 5, the pilot valve 25 has a valve seat 70 integrally formed with the body 31 at the innermost portion of the hole 69 communicating with the check valve 27, and the valve hole of the valve seat 70 communicates with the back pressure chamber at the upper part of the piston 38. A plug 71 is inserted in the hole 69 and formed with a valve seat 72 at a location opposed to the valve seat 70, and passages are formed through the plug 71 and the body 31 such that the valve hole of the valve seat 72 communicates with the back pressure chamber at the upper part of the piston 39. The plug 71 has a pilot valve 73 disposed therein which is formed such that opposite ends thereof opposed to the valve seats 70 and 72 each have a needle shape, whereby the pilot valve 25 is constructed as a three-way switching valve. The pilot valve 73 is urged by a spring 74 such that it is seated on the valve seat 72 formed in the plug 71.

Outside the plug 71, there is provided a solenoid which is disposed coaxially with the plug 71. This solenoid has a core 75 having a portion formed to have a flange-like shape for abutment with the plug 71, and an approximately half of the core 75 is fitted in a sleeve 76. The sleeve 76 has a plunger 77 loosely inserted therein, and the outermost end of the sleeve 76 is gastightly closed by a cap 78. The sleeve 76 has a coil 79 wound around the periphery thereof, and further, the core 75 and the coil 79 are enclosed by a yoke 80. The yoke 80 is screwed into the body 31, whereby the core 75 is pressed against the plug 71.

The core 75 and the plunger 77 have holes formed through respective central portions thereof along the axis. The through hole of the plunger 77 has two steps, and has diameters which are progressively increased toward the cap 78. A holder 81 and a spring 82 are received in a central portion of the through hole, and a plug 83 is press-fitted and fixed in a large-diameter portion formed toward the cap 78. The spring 82 urges the holder 81 such that the holder 81 abuts against a stepped portion formed toward the core 75. Further, a spring 84 weaker in spring force than that of the spring 74 urging the pilot valve 73 is disposed between the plunger 77 and the cap 78.

A shaft 85 is disposed such that it extends in a small-diameter through hole in the plunger 77, through the through hole of the core 75, and in the hole of the plug 71, with one end thereof in abutment with the holder 81 and the other end thereof in abutment with a shaft 86 which is fixed to the pilot valve 73 and extends through the valve hole of the valve seat 72.

Next, a description will be given of the operation of the four-way switching valve constructed as described above. First, when in a solenoid-off state in which the coil 79 of the solenoid is not energized and the refrigerant is not flowing, in the high-pressure main valves 21 and 22, the pistons 38 and 39 are urged by the springs 46 and 47, causing the main valve elements 36 and 37 to be seated on the main valve seats 34 and 35, respectively. In the low-pressure main valves 23 and 24, the main valve elements 54 and 55 are urged by the springs 62 and 63 to be pushed against each other, whereby they are in the neutral position. In the pilot valve, the pilot valve element 73 is urged by the spring 74 to be seated on the valve seat 72. Further, in the check valve 27, the valve element 67 is in a position in which the flow of refrigerant is stopped. The illustrated example shows a state of the heating and cooling system operating used in the cooling operation mode, with the valve element 67 being in a position closing the valve hole on the port T3 side.

Figure 6:
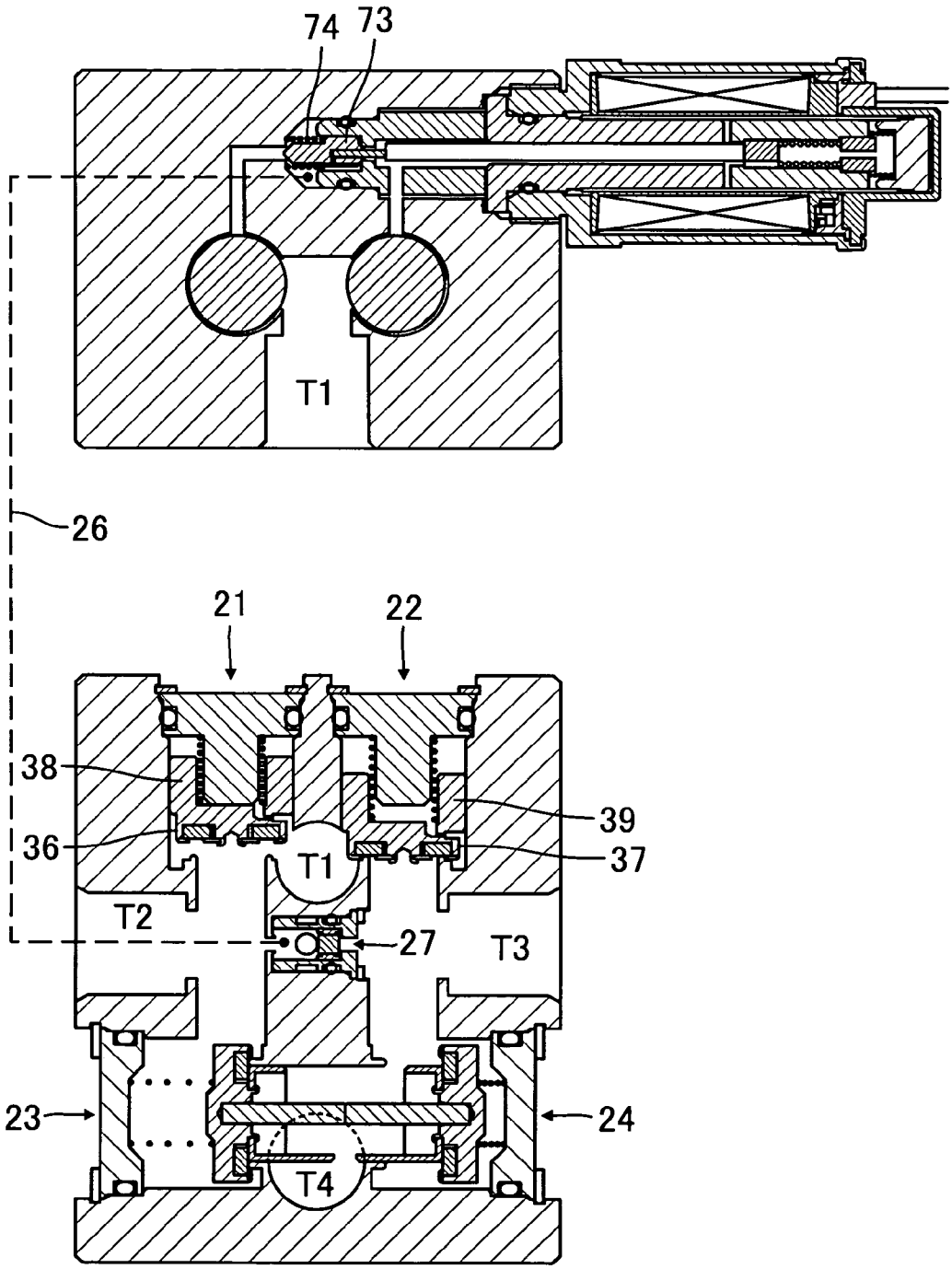
FIG. 6 is a cross-sectional view showing an operating state of the four-way switching valve according to the first embodiment in which the solenoid is off.
Figure 7:
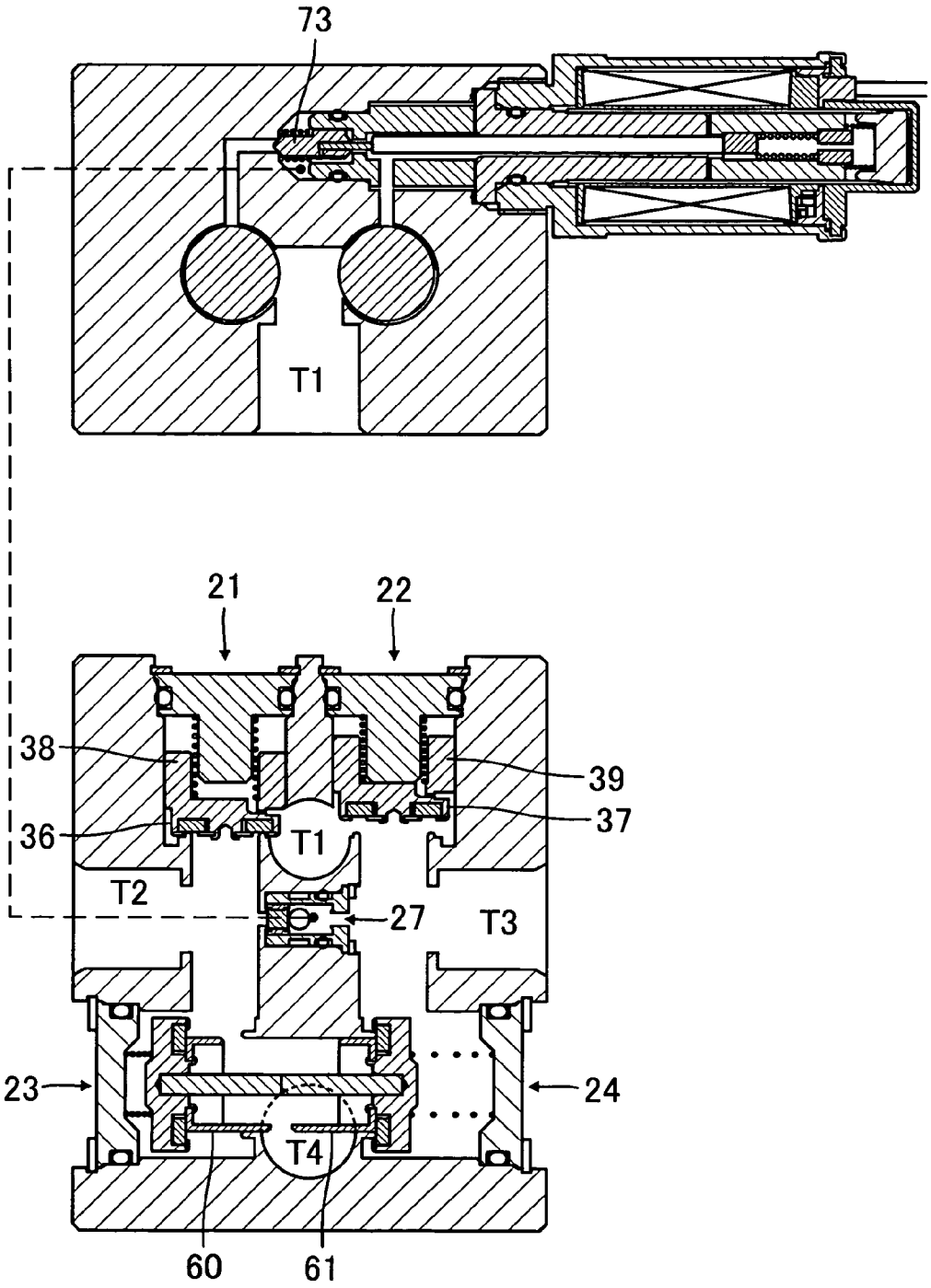

FIG. 6 is a cross-sectional view showing an operating state of the four-way switching valve according to the first embodiment in which the solenoid is off, and FIG. 7 is a cross-sectional view of an operating state of the four-way switching valve according to the first embodiment in which the solenoid is on.

When the high-pressure refrigerant is introduced into the port T1 in the solenoid-off state, as shown in FIG. 6, the pressure of the refrigerant is introduced into the back pressure chambers at the upper parts of the pistons 38 and 39 via the orifices 42 and 43 formed in the pistons 38, 39 of the high-pressure main valves 21, 22, respectively. At this time, the pilot valve element 73 is urged by the spring 74, so that the pilot valve 25 is open for the main valve 21 and is closed for the main valve 22, so that the back pressure chamber at the upper part of the piston 38 communicates with the port T2 or with the port T3 via the pilot valve 25, the pressure passage 26, and the check valve 27. In the illustrated example, the check valve 27 happens to be in the position closed on the port T3 side, so that the back pressure chamber at the upper part of the piston 38 communicates with the port T2. On the other hand, the back pressure chamber at the upper part of the piston 39 is closed by the pilot valve 25.

For this reason, the pressure in the back pressure chamber at the upper part of the piston 38 is reduced since the amount of refrigerant flowing out therefrom into the port T2 is larger than the amount of refrigerant introduced therein via the port T1, so that the piston 38 and the main valve element 36 are pushed upward to open the main valve 21. On the other hand, the pressure in the back pressure chamber at the upper part of the piston 39 is increased, so that the differential pressure acting on the piston 39 and the main valve element 37 moves the piston 39 and the main valve element 37 downward as viewed in the figures to close the main valve 22.

Further, when the main valve 21 is opened and the main valve 22 is closed to make the pressure in the port T2 high and the pressure in the port T3 low, the check valve 27 has the valve element 67 thereof pushed by the differential pressure acting thereon, so that the check valve 27 is placed in the state open on the port T2 side and closed on the port T3 side. This causes the back pressure on the main valve 21 to be released to the port T2 into which the refrigerant flows out from the port T1.

The main valves 23 and 24 on the low pressure side operate according to the operation of the high-pressure main valves 21 and 22. More specifically, due to the operations of the high-pressure main valves 21 and 22, the pressure in the port T2 becomes high and the pressure in the port T3 becomes low, so that the difference in these pressures causes the main valve 23 to be closed and the main valve 24 to be opened.

As a consequence, the high-pressure, high-temperature refrigerant sent under pressure from the compressor 11 enters the port T1 of the four-way switching valve 12 and flows out via the port T2. Then, the refrigerant flows through the outdoor heat exchanger 13 and the expansion device 14 and turns into the low-pressure, low-temperature refrigerant. Then, the refrigerant flows the indoor heat exchanger 15, returns to the port T3 of the four-way switching valve 12, and flows out via the port T4 to return to the compressor 11 via the accumulator 16. Thus, the four-way switching valve 12 switches the operation mode of the automotive heating and cooling system to the cooling operation mode.

Next, when in the state where the high-pressure refrigerant has been introduced into the port T1, if the coil 79 of the solenoid is energized to turn on the solenoid, as shown in FIG. 7, the pilot valve element 73 is pushed by the force of the solenoid to cause the pilot valve to be closed for the main valve 21 and opened for the main valve 22. This cuts off the back pressure chamber at the upper part of the piston 38 from communication with the port T2 to fill the back pressure chamber with the high pressure introduced from the port T1 via the orifice 42, so that the piston 38 is pushed downward as viewed in the figures to close the main valve 21. On the other hand, the back pressure chamber at the upper part of the piston 39 is reduced in pressure due to communication with the check valve 27 via the pilot valve 25 and the pressure passage 26, so that the piston 39 is pushed upward as viewed in the figures to open the main valve 22.

Thus, the high-pressure main valve 21 is closed and the main valve 22 is opened to make the pressure in the port T2 low and the pressure in the port T3 high, so that the difference in the pressures causes the check valve 27 to be closed on the port T2 side and opened on the port T3 side. This causes the back pressure acting on the main valve 22 to be released to the port T3 into which the refrigerant flows out from the port T1.

As for the low-pressure main valves 23 and 24, since the high-pressure main valves 21 and 22 operate to make the pressure in the port T2 low and the pressure in the port T3 high, the difference in the pressures causes the main valve 23 to be opened and the main valve 24 to be closed. During the switching of the main valves 23 and 24, the main valve 23 having been closed is moved in the valve-opening direction and the main valve 24 having been open is moved in the valve-closing direction, and therefore, there can be a region in which these main valves 23 and 24 are to open at the same time in the course of the switching. However, in the region where both the main valves 23 and 24 are to open at the same time, the skirts 60 and 61 provided on the main valve elements 54 and 55 close the main valves 23 and 24 at the same time, so that during the switching of the low-pressure main valves 23 and 24, the main valves 23 and 24 are prevented from both opening at the same time, which prevents the high-pressure refrigerant from directly flowing out into the port T4 low in pressure.

As a consequence, the high-pressure, high-temperature refrigerant sent under pressure from the compressor 11 enters the port T1 of the four-way switching valve 12 and flows out from the port T3. Then, the refrigerant flows through the indoor heat exchanger 15 and the expansion device 14 and turns into the low-pressure, low-temperature refrigerant. Then, the refrigerant flows through the outdoor heat exchanger 13, returns to the port T2 of the four-way switching valve 12, and flows out via the port T4 to return to the compressor 11 via the accumulator 16. Thus, the four-way switching valve 12 switches the operation mode of the automotive heating and cooling system from the cooling operation mode to the heating operation mode.

Figure 8:
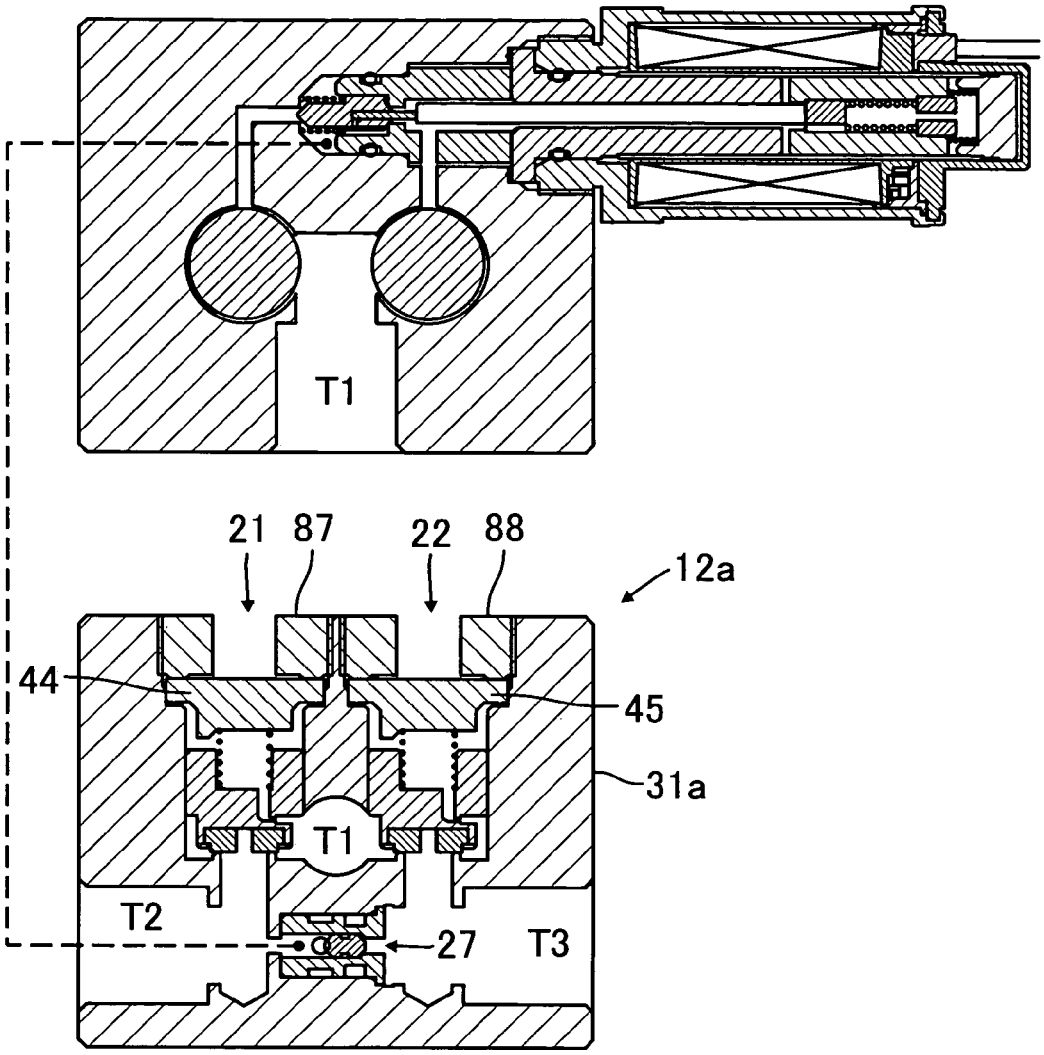
FIG. 8 is a cross-sectional view of the internal construction of a high-pressure section of a four-way switching valve according to a second embodiment of the present invention.
Figure 9:
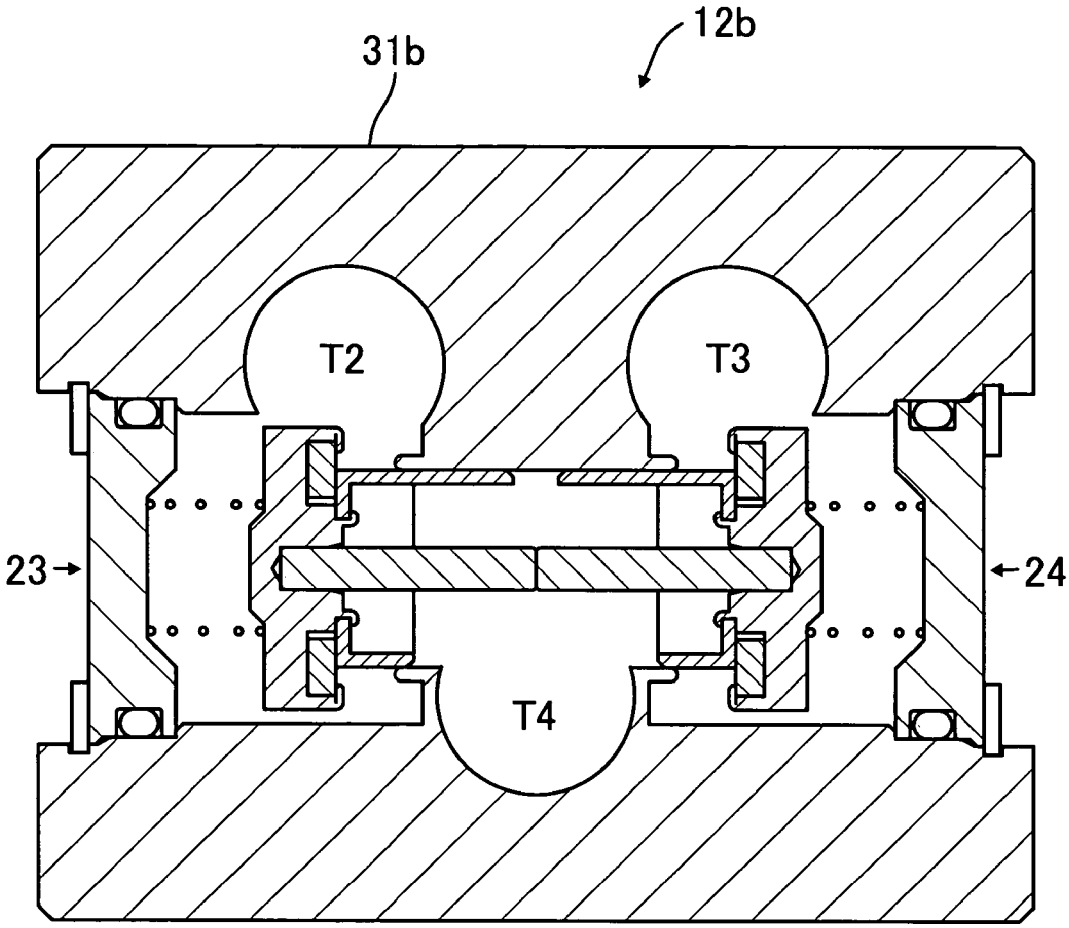
FIG. 9 is a cross-sectional view of the internal construction of a low-pressure section of the four-way switching valve according to the second embodiment.

FIG. 8 is a cross-sectional view of the internal construction of a high-pressure section of a four-way switching valve according to a second embodiment of the present invention, and FIG. 9 is a cross-sectional view of the internal construction of a low-pressure section of the four-way switching valve according to the second embodiment. In FIGS. 8 and 9, components identical to those of the four-way switching valve shown in FIGS. 2 through 5 are designated identical reference numerals, and detailed description thereof is omitted.

The four-way switching valve according to the second embodiment is distinguished from the four-way switching valve according to the first embodiment in that a high-pressure three-way switching valve 12*a* which is pilot-operated and a low-pressure three-way switching valve 12*b* which is mechanically operated are separately provided, and the high-pressure three-way switching valve 12*a* and the low-pressure three-way switching valve 12*b* are shown in FIGS. 8 and 9, respectively.

The high-pressure three-way switching valve 12*a* basically has the same construction as that of the high-pressure section of the four-way switching valve 12 according to the first embodiment. However, in the present embodiment, plugs 44 and 45 closing the open ends of cylinders 32 and 33 are sealed by bringing the plugs 44 and 45 into pressure contact with a body 31*a* with screws 87 and 88, respectively.

The low-pressure three-way switching valve 12*b* has a separately-provided body 31*b* which has ports T2, T3, and T4. Except for the above, this valve 12*b* has the same construction as that of the low-pressure section of the four-way switching valve 12 according to the first embodiment.

As described above, the three-way switching valve 12*a* for switching the high-pressure, high-temperature refrigerant and the three-way switching valve 12*b* for switching the low-pressure, low-temperature refrigerant are constructed separately, which makes it possible to separately arrange the three-way switching valve 12*a* dealing with the high-temperature refrigerant and the three-way switching valve 12*b* dealing with the low-temperature refrigerant. This makes it possible to prevent heat from being exchanged via the common body 31, and thermally cut off the two valves 12*a* and 12*b* from each other. Therefore, the refrigerant raised in temperature by the compressor 11 is prevented from being cooled by the refrigerant having returned after being dropped in temperature at the expansion device 14, so that the heating performance is prevented from being lowered. Further, the separate bodies increase the degree of freedom of layout of the four-way switching valve, which makes it possible to arrange the high-pressure and low-pressure three-way switching valves 12*a* and 12*b* at convenient locations from the viewpoint of piping.

As described heretofore, according to the present invention, the four-way switching valve is constructed such that the differential pressure between outlet ports generated according to the switching operation of the high-pressure three-way switching valve switches the low-pressure three-way switching valve. This makes it possible to form the four-way switching valve simple construction. Further, poppet valves can be employed as the valves for switching passages of refrigerant. This improves the sealability and prevents unusual noise from being generated when the switching of the operation mode is performed.

The pressure passages for releasing the pressures in the back pressure chambers of the pistons are formed through the body, which makes it possible to dispense with externally mounted parts, such as tubes, so that the number of components parts can be reduced to make the valve small in size.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A four-way switching valve that performs switching such that a first port communicates with a second port or with a third port, and at the same time performs switching such that a fourth port communicates with the third port or with the second port, the four-way switching valve comprising:

a high-pressure three-way switching valve that performs switching such that high-pressure refrigerant supplied to the first port is caused to flow to the second port or to the third port; and a low-pressure three-way switching valve that performs switching such that low-pressure refrigerant supplied to the second port or the third port is caused to flow to the fourth port, by a differential pressure generated between pressure in the second port and pressure in the third port according to switching operation of the high-pressure three-way switching valve.

2. The four-way switching valve according to claim 1, wherein the high-pressure three-way switching valve comprises:

a first main valve that is disposed between the first port and the second port and has a poppet valve structure;

a first piston that has a back pressure chamber supplied with the refrigerant from the first port and actuates the first main valve;

a second main valve that is disposed between the first port and the third port and has a poppet valve structure;

a second piston that has a back pressure chamber supplied with the refrigerant from the first port and actuates the second main valve;

a solenoid-driven pilot valve that selectively releases pressures in the back pressure chambers of the first piston and the second piston; and a check valve that is disposed between the second port and the third port and performs switching such that a pressure passage from the pilot valve communicates with the second port or with the third port, by a differential pressure between the second port and the third port, wherein the pressure passage between the pilot valve and the check valve is formed through a body.

3. The four-way switching valve according to claim 1, wherein the low-pressure switching valve comprises:

a third main valve that is disposed between the second port and the fourth port and has a poppet valve structure for being driven in a valve-closing direction by a refrigerant pressure in the second port; and a fourth main valve that is disposed between the third port and the fourth port on the same axis as that of the third main valve and has a poppet valve structure for being driven in a valve-closing direction by a refrigerant pressure in the third port.

4. The four-way switching valve according to claim 3, wherein the third main valve and the fourth main valve comprise two springs disposed axially outward thereof for urging respective valve elements thereof in valve-closing directions, shafts disposed between the valve elements for holding the valve elements at locations away from valve seats associated therewith in a neutral state in which there is no differential pressure between the second port and the third port, and skirts extending respectively from the valve elements such that each of the skirts is inserted into a valve hole, for blocking between the second port and the fourth port and between the third port and the fourth port, at least in the neutral state.

5. The four-way switching valve according to claim 1, wherein the high-pressure three-way switching valve and the low-pressure three-way switching valve have respective separate bodies.

* * * * *